US008146630B2

(12) United States Patent
Hummel

(10) Patent No.: US 8,146,630 B2
(45) Date of Patent: Apr. 3, 2012

(54) METHOD OF CHANGING THE DISTANCE BETWEEN A ROTARY CUTTING TOOL AND A WORK SURFACE

(75) Inventor: Richard M. Hummel, Parma, OH (US)

(73) Assignee: Woodpeckers, Inc., North Royalton, OH (US)

( * ) Notice: Subject to any disclaimer, the term of this patent is extended or adjusted under 35 U.S.C. 154(b) by 0 days.

(21) Appl. No.: 13/206,595

(22) Filed: Aug. 10, 2011

(65) Prior Publication Data

US 2011/0289747 A1 Dec. 1, 2011

Related U.S. Application Data

(60) Division of application No. 12/891,171, filed on Sep. 27, 2010, now Pat. No. 8,020,593, which is a division of application No. 12/464,248, filed on May 12, 2009, now Pat. No. 7,810,530, which is a continuation of application No. 11/401,573, filed on Apr. 10, 2006, now Pat. No. 7,559,347.

(51) Int. Cl.
*B27M 3/00* (2006.01)
*B27C 5/02* (2006.01)

(52) U.S. Cl. ..... 144/371; 409/206; 409/210; 144/286.5

(58) Field of Classification Search ..... 144/371, 144/136.1, 136.95, 154.5, 286.5; 409/182, 409/206, 210, 214, 218
See application file for complete search history.

(56) References Cited

U.S. PATENT DOCUMENTS

| | | | | |
|---|---|---|---|---|
| 4,537,234 | A | 8/1985 | Onsrud | |
| 5,139,061 | A | 8/1992 | Neilson | |
| 6,318,936 | B1 | 11/2001 | McFarlin, Jr. et al. | |
| 6,505,659 | B1 | 1/2003 | Hummel | |
| 6,550,154 | B1 | 4/2003 | Smith | |
| 6,725,892 | B2 | 4/2004 | McDonald et al. | |
| 6,739,066 | B2 | 5/2004 | Smith | |
| 6,863,480 | B1 | 3/2005 | Taylor | |
| 6,926,479 | B1 | 8/2005 | Taylor | |
| 6,948,892 | B2 | 9/2005 | Hummel | |
| 6,951,232 | B2 | 10/2005 | McDonald et al. | |
| 6,966,122 | B2 | 11/2005 | Smith | |
| 6,991,008 | B2 * | 1/2006 | McDonald et al. | 144/136.95 |
| 7,559,347 | B2 * | 7/2009 | Hummel | 144/136.1 |
| 7,810,530 | B2 * | 10/2010 | Hummel | 144/136.1 |
| 2008/0078472 | A1 | 4/2008 | Hummel | |

* cited by examiner

*Primary Examiner* — Shelley Self
(74) *Attorney, Agent, or Firm* — Sand & Sebolt

(57) ABSTRACT

A method of changing the distance between a rotary cutter disposed on a carriage assembly and a work surface. The method includes the steps of providing a first mechanism on the carriage assembly for making small distance changes between the rotary cutter and the work surface and providing a second mechanism on the carriage assembly for making larger distance changes between the rotary cutter and the work surface. The user selects one of the first and the second mechanisms to adjust the distance between the rotary cutter and the work surface and then activates the selected one of the first and the second mechanisms. Activation of the second mechanism automatically disengages the first mechanism.

18 Claims, 8 Drawing Sheets

METHOD OF CHANGING THE DISTANCE BETWEEN A ROTARY CUTTING TOOL AND A WORK SURFACE

CROSS-REFERENCE TO RELATED APPLICATIONS

This application is a division of U.S. patent application Ser. No. 12/891,171, filed on Sep. 27, 2010, which is a division of U.S. patent application Ser. No. 12/464,248 filed on May 12, 2009, now U.S. Pat. No. 7,810,530, which is a continuation of U.S. patent application Ser. No. 11/401,573 filed on Apr. 10, 2006, now U.S. Pat. No. 7,559,347, the specifications of which are incorporated by reference herein in their entirety.

BACKGROUND OF THE INVENTION

1. Technical Field

The invention relates generally to a rotary cutter which is mounted on a work table. More particularly, the invention relates to an assembly for raising and lowering the cutter wherein the assembly allows for rapid, coarse adjustments as well as the fine adjustments. Specifically, the invention relates to such an assembly which includes a lift handle for rapidly raising and lowering the rotary cutter and an adjustment screw for providing the fine adjustments.

2. Background Information

Various types of rotary cutters such as routers are known in the art which are mounted on work tables which provide a work surface on which wood or other work materials may be seated during the cutting thereof by the rotary cutter. A variety of mechanisms are known in the art for raising and lowering the rotary cutter with respect to the table or work surface thereof. Such mechanisms include threaded adjusting screws for finely adjusting the height of the rotary cutter. For example, see U.S. Pat. No. 6,505,659 granted to Hummel. Such adjusting screw mechanisms and other fine adjustment mechanisms provide accurate height adjustment but are not capable of rapidly raising and lowering the cutter when coarser adjustments are desired. Thus, there remains a need in the art for such a rapid adjustment assembly which is also suitable for use with a fine adjustment mechanism.

BRIEF SUMMARY OF THE INVENTION

The present invention provides an apparatus comprising a table plate; a carriage assembly disposed beneath the table plate and adapted for supporting a rotary cutter; and a lift handle which is mountable on and extends upwardly from the carriage assembly and extends above the table plate for supporting the carriage assembly during manual raising and lowering of the carriage assembly via the lift handle.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
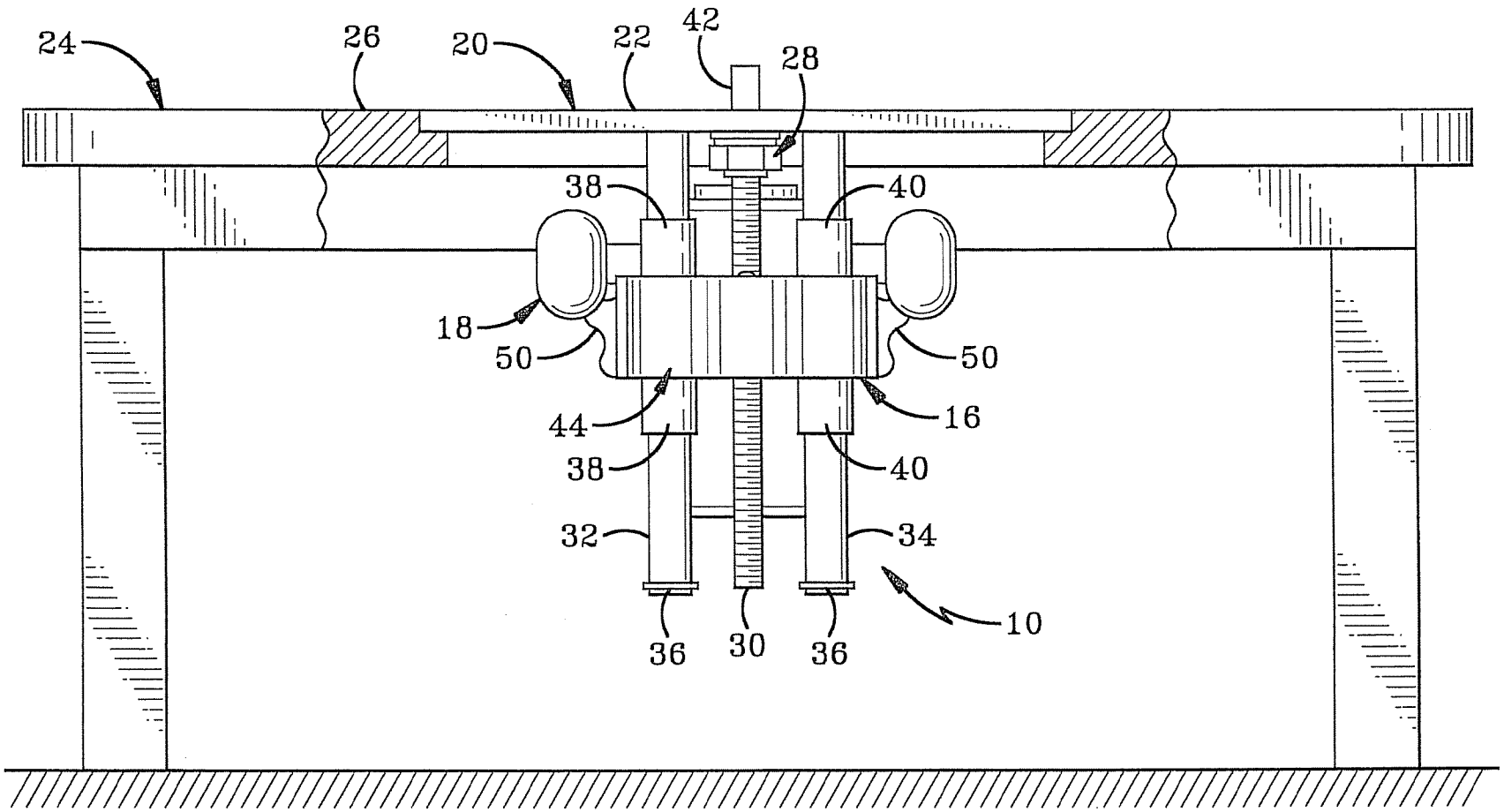
FIG. 1 is a front elevational view with portions cut away showing the adjustment assembly of the present invention mounted on a table without the lift handle and fine adjustment handle shown.
Figure 12:
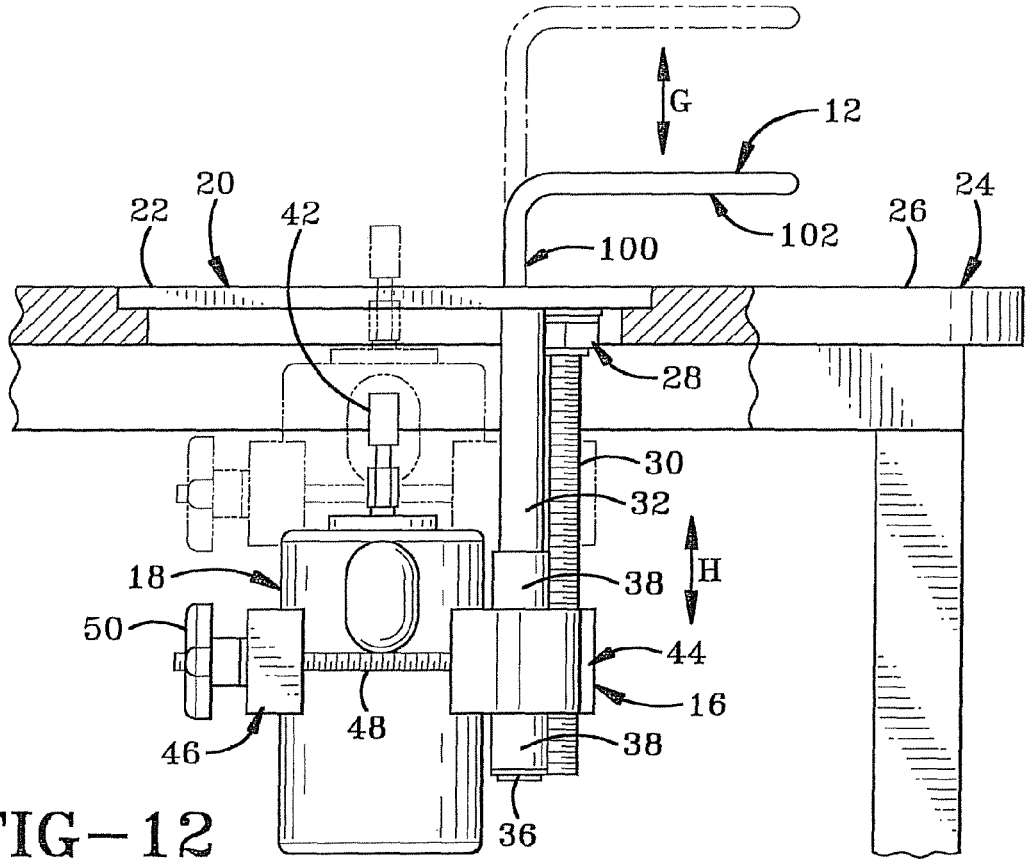
FIG. 12 is a fragmentary side elevational view similar to FIG. 7 showing the lift handle in the lifting position and illustrating the rapid raising and lowering of the carriage assembly and rotary cutter.
Figure 6:
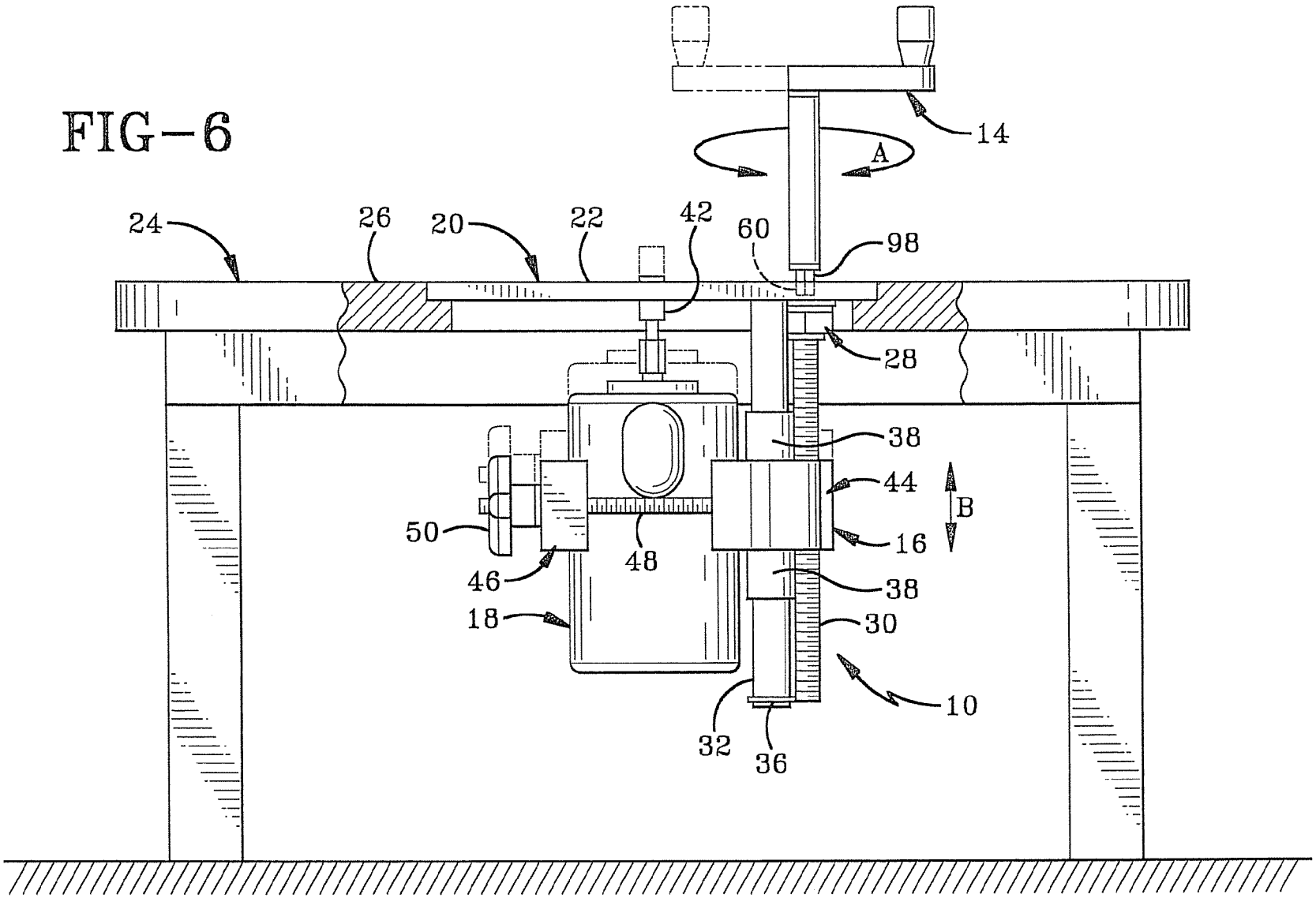
FIG. 6 is a side elevational view similar to FIG. 2 showing the operation of the fine adjustment handle for providing fine vertical adjustment of the carriage assembly and rotary cutter.

The adjustment assembly of the present invention is indicated generally at 10 in FIGS. 1, 6 and 12 and includes a lift handle 12 (FIG. 12) and a fine adjustment handle 14 (FIG. 6). Assembly 10 further includes a carriage assembly 16 for mounting thereon a rotary cutter such as a router 18. Lift handle 12 is configured for the rapid raising and lifting of carriage assembly 16 and router 18 while fine adjustment handle 14 is configured for the fine vertical adjustment of assembly 16 and router 18.

Assembly 10 further includes a table plate 20 having an upper work surface 22. Table plate 20 is mounted on a work table 24 having an upper work surface 26 so that upper surfaces 22 and 26 are substantially coplanar and horizontal. Assembly 10 further includes a support assembly 28 which is mounted on and extends downwardly from table plate 20 and includes an adjustment screw 30 which is elongated in a substantially vertical direction and is rotatable about a substantially vertical axis in order to provide fine vertical adjustment of carriage assembly 16. Support assembly 28 is described in greater detail in U.S. Pat. No. 6,948,892 granted to Hummel, which is incorporated herein by reference. Handle 14 is also described in further detail in said patent. Assembly 10 further includes first and second guide posts 32 and 34 each having a respective stop 36 disposed adjacent a lower end thereof to limit the travel of carriage assembly 16, which is slidably mounted on guide post 32 and 34 respectively via first and second bushings 38 and 40. Router 18 is mounted on carriage assembly 16 so that a rotary cutter bit 42 may extend above upper surface 22 of table plate 20 when in an operational cutting position. Router 18 rotates cutter bit 42 around a substantially vertical axis during operation.

Figure 2:
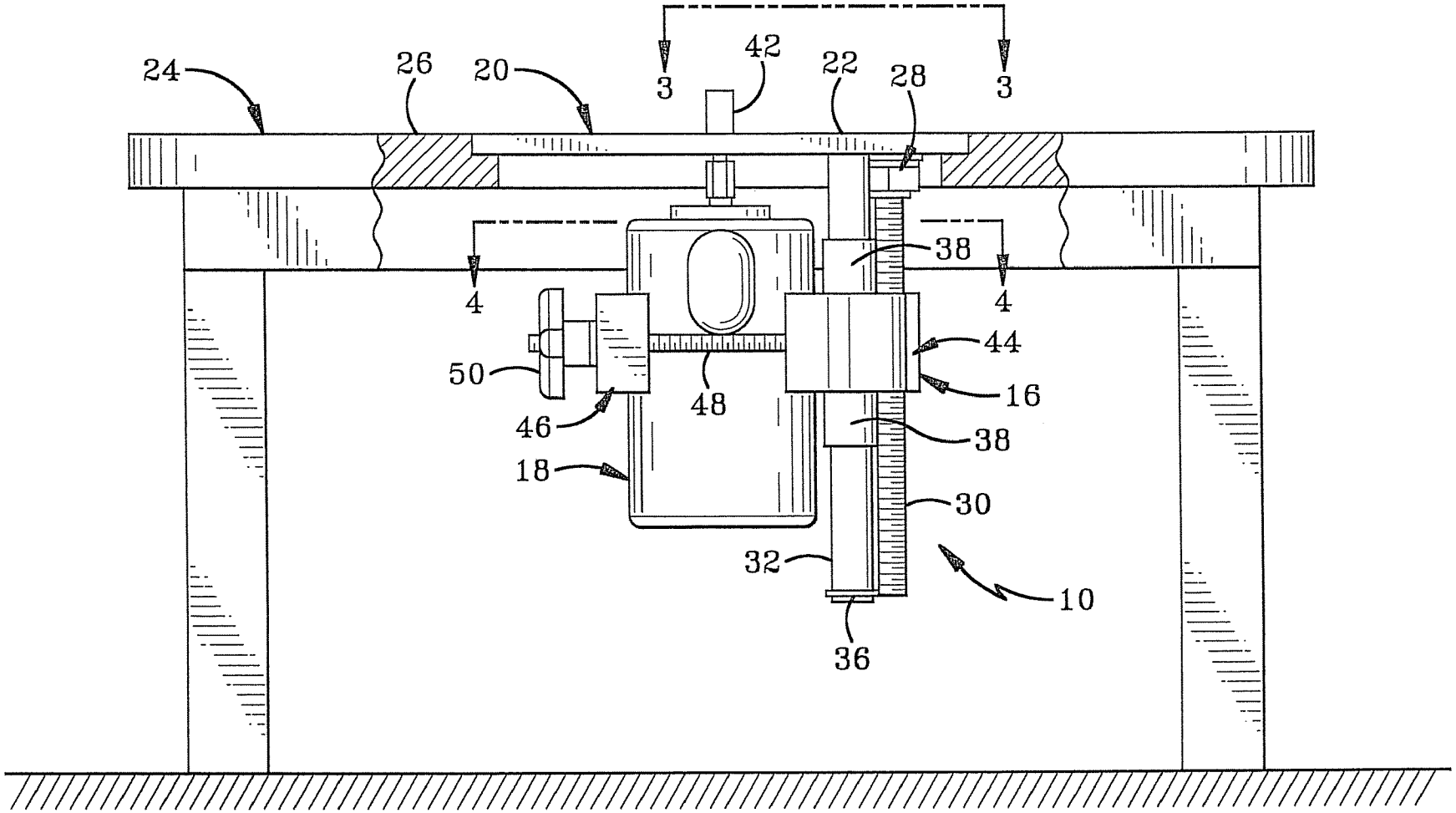
FIG. 2 is a side elevational view with portions cut away of the adjustment assembly and table of FIG. 1.

With reference to FIG. 2, carriage assembly includes first and second clamping members 44 and 46 which are connected to one another via a pair of spaced threaded rods 48 on which are threadably mounted a respective pair of threaded handles 50 for tightening and loosening clamping members 44 and 46 about router 18.

Figure 3:
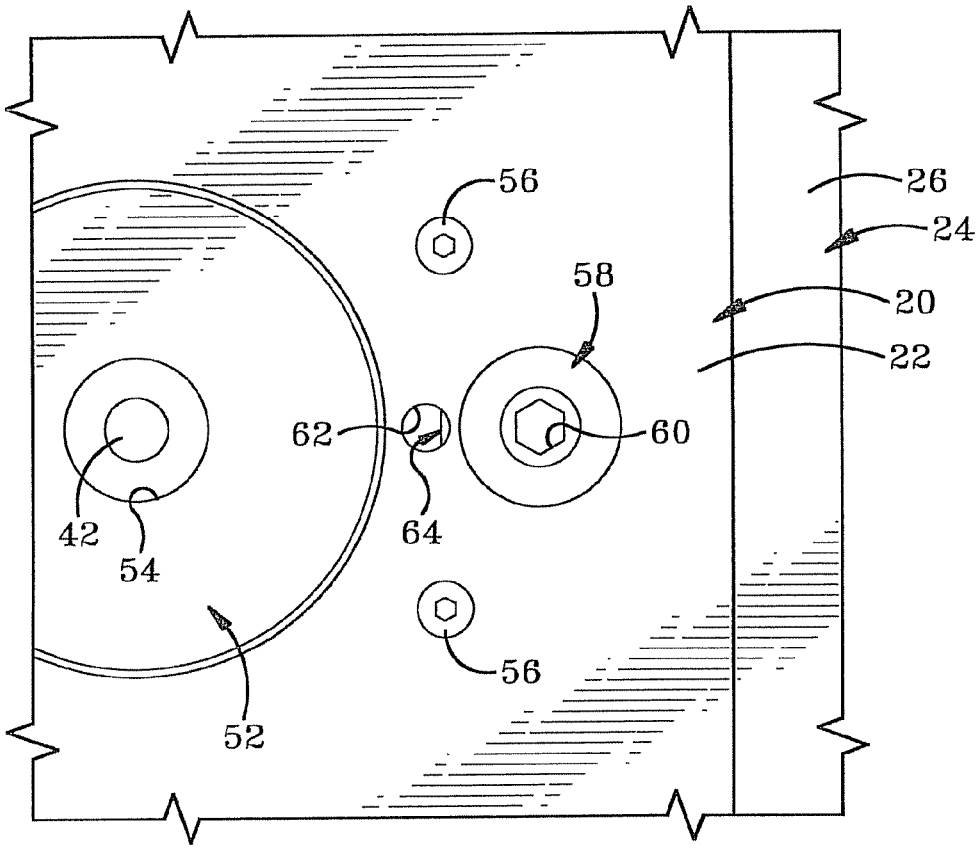
FIG. 3 is a sectional view taken on line 3-3 of FIG. 2.

Referring to FIG. 3, a ring member 52 is removably mounted on table plate 20 and defines a central through opening 54 through which router bit 42 extends upwardly of table plate 20. Ring member 52 may be replaced by an alternate ring member to accommodate different sized cutter bits 42. In addition, ring member 52 is removable in order to allow router 18 to move upwardly to a position which allows cutter bit 42 to be removed and replaced at a position above table plate 20. The rapid vertical adjustment provided by lift handle 12 greatly expedites the ability to remove and replace cutter bits. FIG. 3 also shows a pair of mounting screws 56 for mounting guide posts 32 and 34 on table plate 20. A cap member 58 is rotatably mounted on table plate 20 and defines a central hexagonal recess 60 adapted to matingly engage a portion of handle 14 for rotation of cap member 60 and adjustment screw 30. Table plate 20 also defines a through opening 62 which is disposed between and aligned with opening 42 and recess 60 of cap member 58. A portion of a lift-handle engaging member 64 of carriage assembly 16 is visible through opening 62 and is secured to first clamping member 44 via a mounting screw 66 as shown in FIG. 4.

Figure 4:
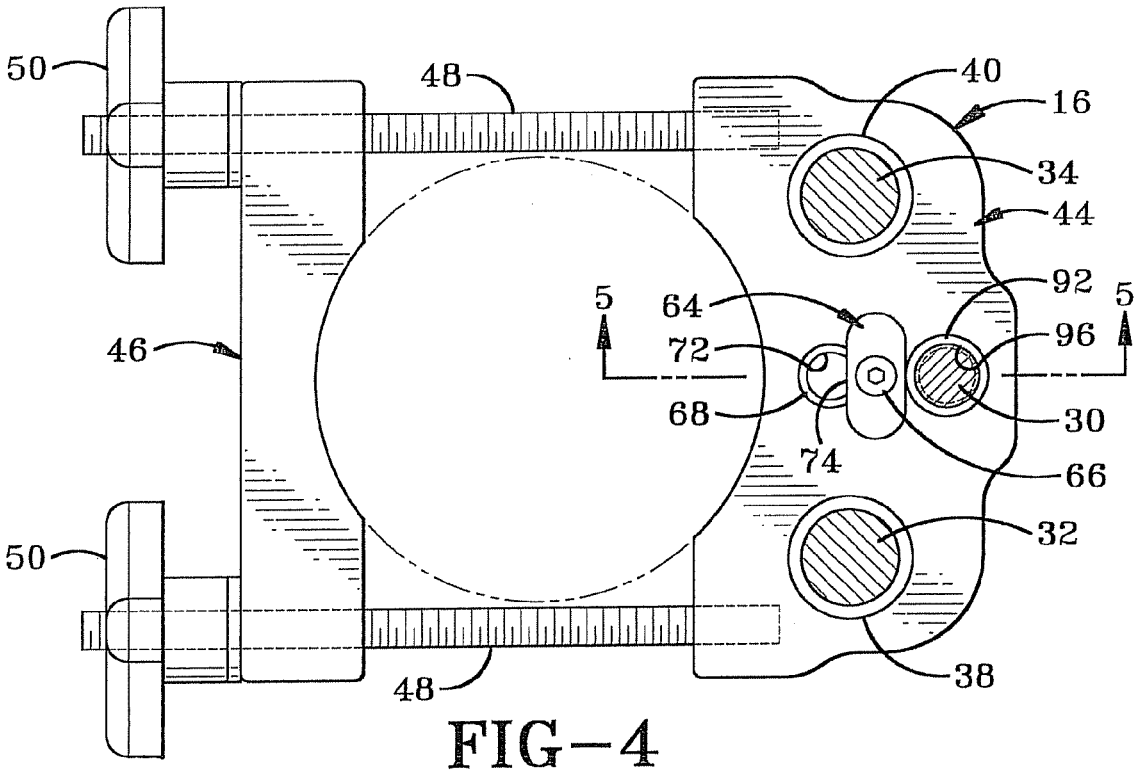
FIG. 4 is a sectional view taken on line 4-4 of FIG. 2.
Figure 5:
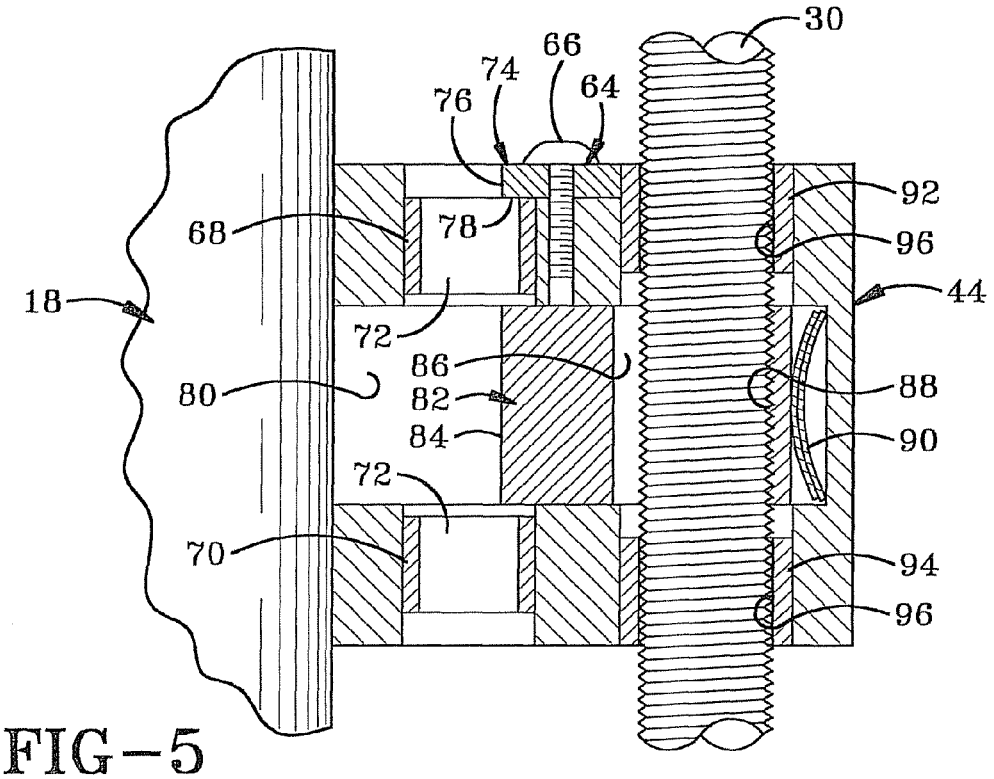
FIG. 5 is a sectional view taken on line 5-5 of FIG. 4.

Referring to FIGS. 4 and 5, first clamping member 44 defines a vertically extending opening in which are disposed upper and lower bushings 68 and 70 which define portions of a cylindrical lift-handle-receiving opening 72. Engaging member 64 includes a projection 74 which extends over a portion of opening 72. Projection 74 has a flat side 76 disposed above opening 72 and a downwardly facing surface or ledge 78 which is engagable by lift handle 12 so that handle 12 may support carriage assembly 16 during raising and lowering thereof as will be further detailed below. First member 44 further defines a horizontally extending passage 80 which is disposed between bushings 68 and 70 and communicates with the respective portions of openings 72 defined thereby. An adjustment screw engaging member 82 is movably disposed in passage 80 and more particularly is slidable in a horizontal direction therein. Member 82 has a laterally facing flat lift-handle-engaging surface 84 which is vertically aligned with flat side 76 of projection 74. Member 82 defines a vertically extending through passage 86 for receiving therethrough adjustment screw 30. Member 82 includes a threaded side or section 88 which bounds passage 86 and is disposed only along one side of adjustment screw 30 for selective engagement therewith. Threaded section 88 of member 82 is spring biased into the engaged position shown in FIG. 5 by spring members 90 which are disposed in passage 80. Passage 86 is wider than the outer diameter of adjustment screw 30 so that engaging member 82 may be moved against the spring bias of spring members 90 from the engaged position shown in FIG. 5 to the disengaged position shown in FIG. 10. First clamping member 44 further defines a second vertically extending passage in which are disposed upper and lower bushings 92 and 94 each defining a portion of a vertically extending passage 96 through which adjustment screw 30 passes. Threaded section 88 of engaging member 82 is thus the only portion of carriage assembly 16 which threadably engages adjustment screw 30. Thus, the threaded engagement between screw 30 and section 88 provides for the fine vertical adjustment of carriage assembly 16 during rotation of screw 30.

The operation of assembly 10 is described with reference to FIGS. 6-12. FIG. 6 shows a hexagonal end portion 98 having been inserted matingly into recess 60 of cap member 58 and illustrates the rotation of handle 14 at Arrows A to provide the fine vertical adjustment indicated at Arrows B of carriage assembly 16 and router 18 via the threaded engagements with section 88 of engaging member 82 (FIG. 5).

Figure 7:
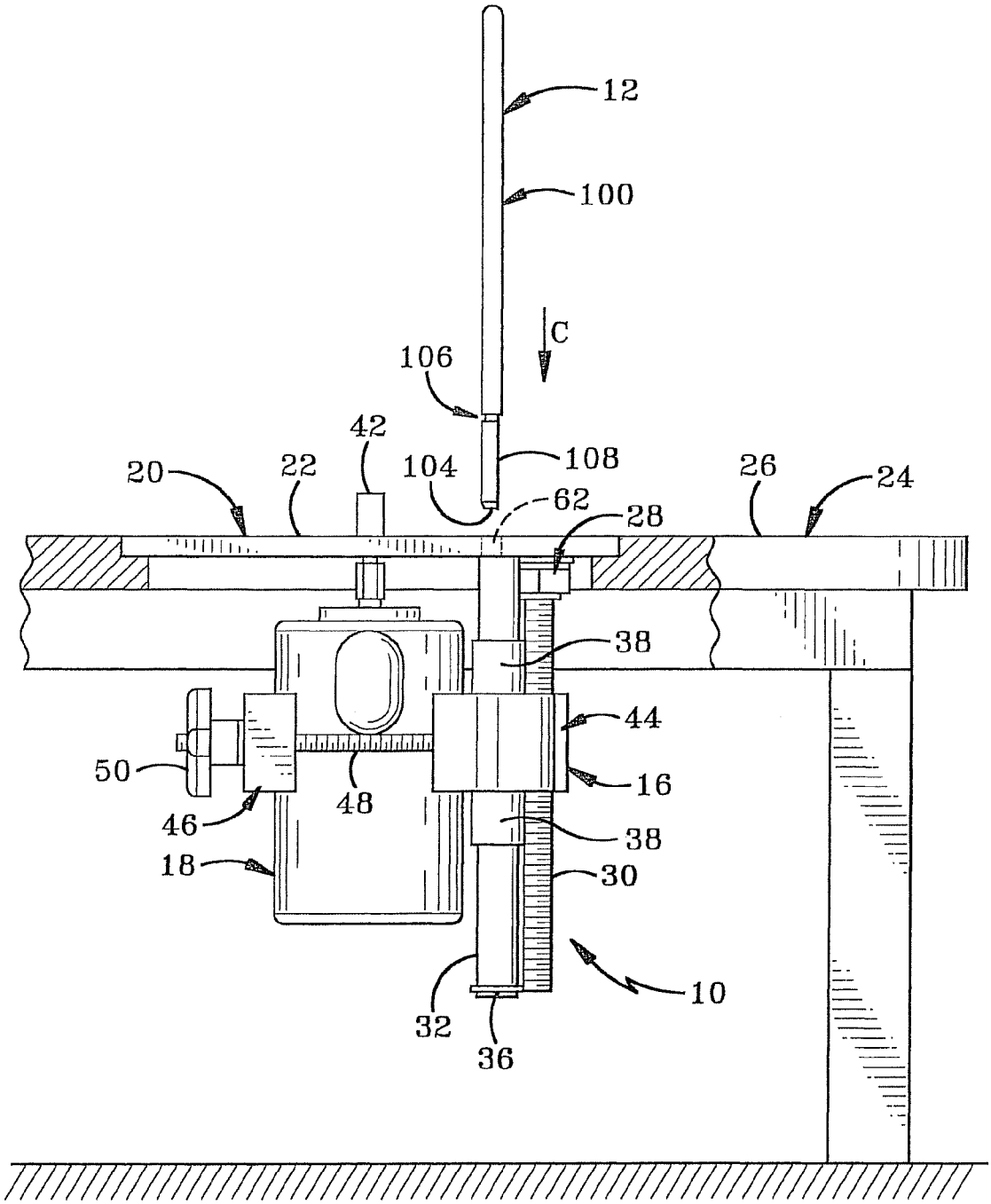
FIG. 7 is a fragmentary side elevational view similar to FIG. 2 showing the lift handle moving from an unmounted position toward a mounted position.

Referring to FIGS. 7-12, the operation of lift handle 12 to provide rapid vertical adjustment of carriage assembly 16 and router 18 is described. FIG. 7 shows handle 12 moving downwardly as indicated at Arrow C prior to insertion thereof through opening 62 of table plate 20. Opening 62 is vertically aligned with handle receiving opening 72 of first clamping member 44 and thus serves to guide handle 12 into opening 72. Handle 12 has an L-shaped configuration including a straight substantially cylindrical rod 100 and a grip 102 (FIG. 12) which extends outwardly from rod 100 at an upper end thereof. In the operational position of handle 12, rod 100 is oriented vertically and grip 102 is oriented horizontally. Preferably, handle 12 is an integrally formed one piece member wherein a straight rod is bent to form rod 100 and grip 102. Rod 100 is tapered adjacent a lower end 104 thereof to facilitate insertion of rod 100 through openings 62 of table plate 20 and 72 of carriage assembly 16. An arcuate circumferentially extending groove 106 is formed in rod 100 and spaced upwardly from and adjacent lower end 104. Rod 100 includes a flat surface 108 extending from lower end 104 to groove 106.

Figure 8:
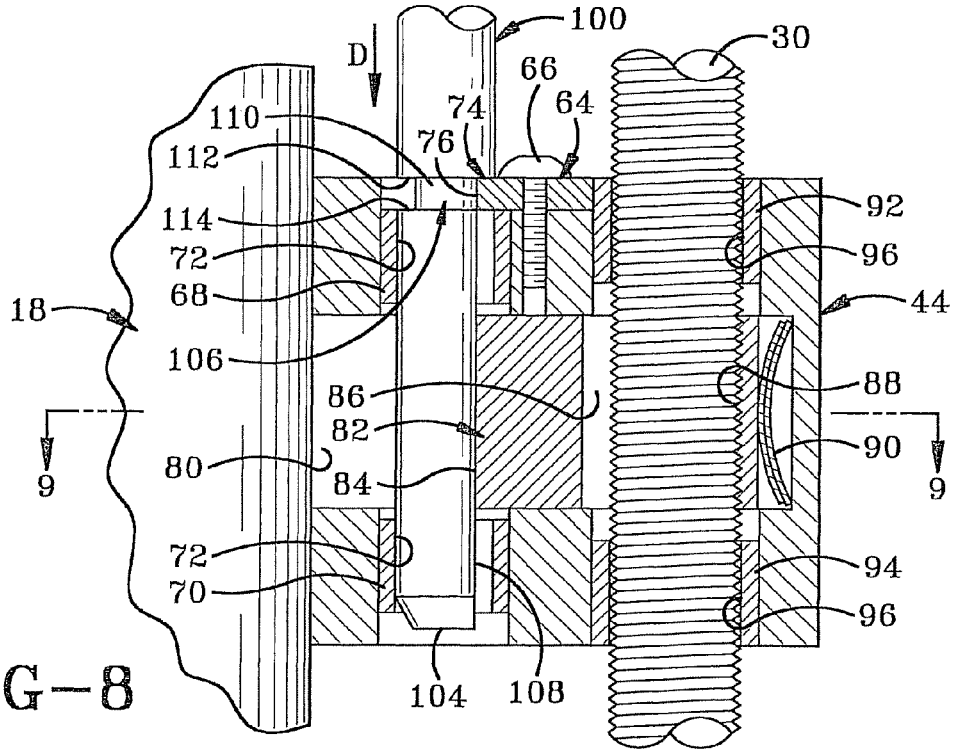
FIG. 8 is an enlarged fragmentary sectional view of a portion of FIG. 7 from the same perspective as FIG. 7 showing the lift handle having been inserted into the carriage assembly.

FIG. 8 shows the lower portion of handle 12 having been inserted into opening 72 so that flat surface 108 of rod 100 is disposed closely adjacent or in abutment with flat surface 84 of engaging member 82 in a substantially coplanar orientation. During insertion of handle 12 into opening 72, flat side 76 of engaging member 64 serves to align flat surface 108 with flat surface 84. Groove 106 is bounded by a cylindrical neck 110 which has a diameter which is smaller than that of the portion of rod 100 thereabove whereby rod 100 is stepped between the differing diameter sections to form a downwardly facing annular ledge 112 a portion of which engages the upper surface of projection 74 of engaging member 64 whereby projection 74 serves as a stop to prevent further downward movement of handle 12. Rod 100 also includes an arcuate lower ledge 114 which faces upwardly and bounds groove 106.

Figure 10:
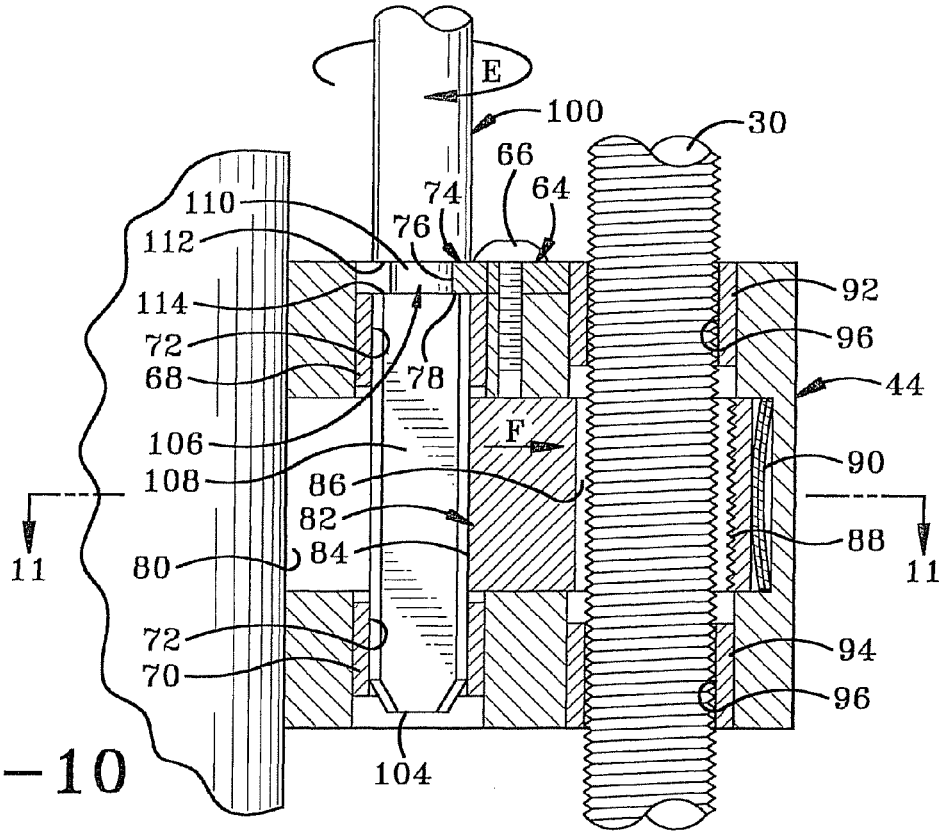
FIG. 10 is similar to FIG. 8 and shows the lift handle having been rotated to position the lift handle in a mounted lifting position and to disengage the engaging member from the fine adjustment screw.
Figure 9:
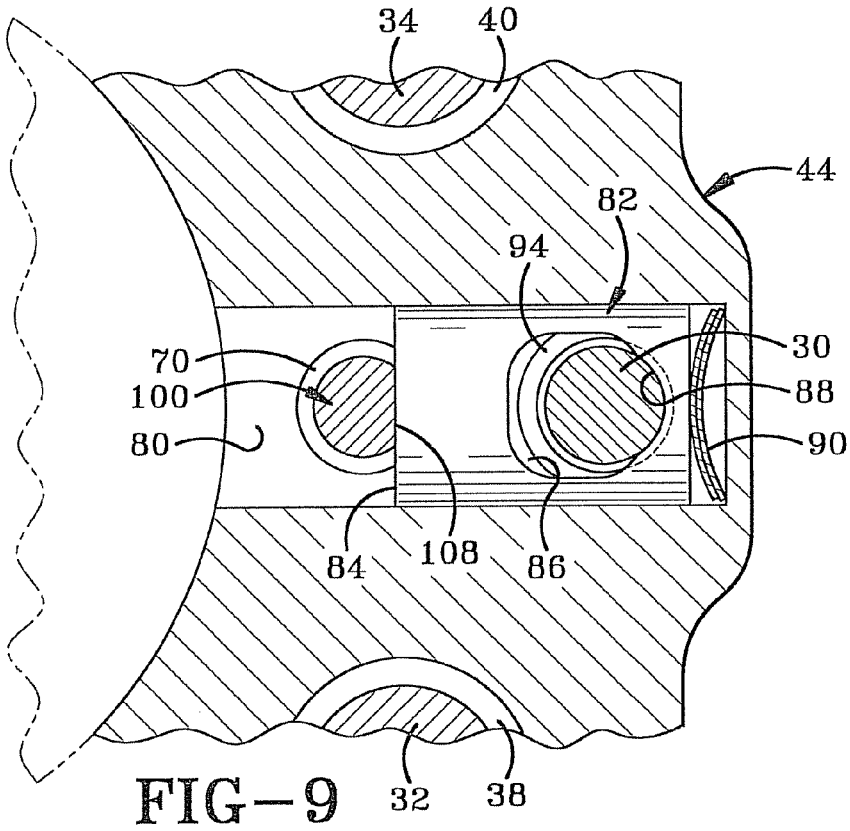
FIG. 9 is a sectional view taken on line 9-9 of FIG. 8.
Figure 11:
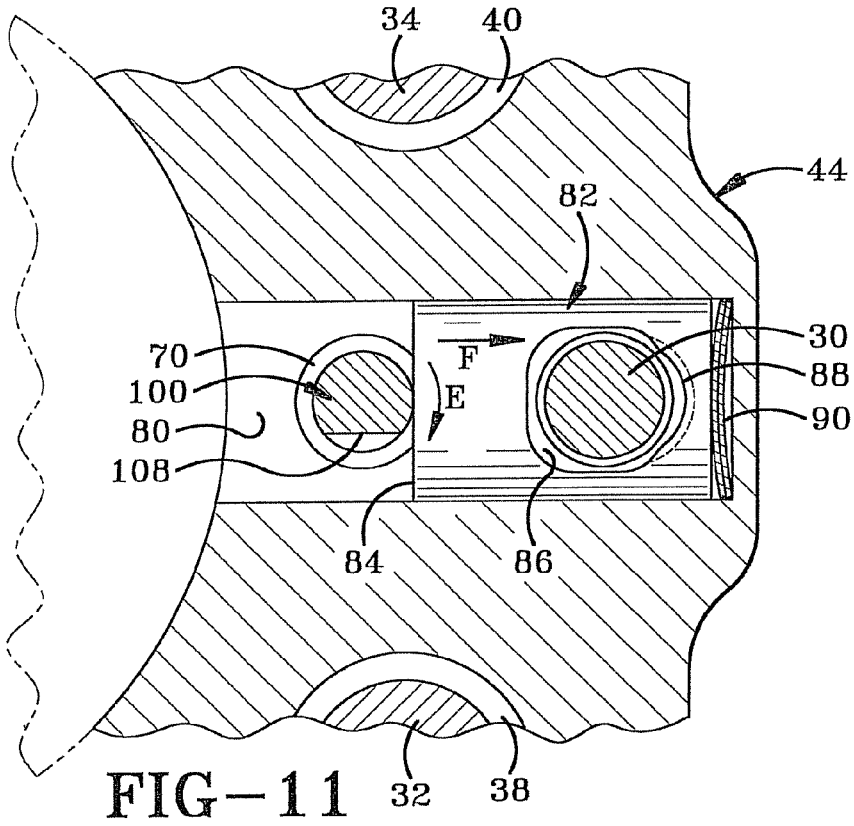
FIG. 11 is a sectional view taken on line 11-11 of FIG. 10.

Once handle 12 is inserted, it is rotated as indicated at Arrows E in FIGS. 10 and 11 to move engaging member 82 horizontally in a linear manner as indicated by Arrows F in FIGS. 10 and 11 to the disengaged position in which threaded section 88 is disengaged from the threads of adjusting screws 30. Just prior to the disengagement of member 82, lower ledge 114 of rod 100 is rotated below projection 74 and into engagement with ledge 78 thereof so that handle 12 is ready to support the weight of carriage 16 and router 18 via the engagement of ledges 78 and 114 before carriage assembly 16 is disengaged from adjusting screw 30. The rotation of handle 12 thus positions projection 74 within groove 106. It is noted that the threads of threaded section 88 of engaging member 82 lie along the arc of a circle which is less than 180° to ensure the ability for the movement of engaging member 82 to the disengaged position. However, it is desirable to produce threaded section 88 with the greatest arc possible within this limitation to provide sufficient strength and longevity for the threads of engaging member 82.

Once the disengaged position has been achieved, handle 12 is raised or lowered as indicated at Arrows G in FIG. 12 to correspondingly raise and lower carriage assembly 16 and router 18 as indicated at Arrows H. In the disengaged position, carriage assembly 16 is thus vertically slidable with bushings 92 and 94 sliding over adjustment screw 30 and bushing 38 and 40 respectively sliding along guide posts 32 and 34. In the disengaged position of engaging member 82, handle 12 is in a fixed vertical relation with carriage assembly 16 and router 18 whereby they all move upwardly and downwardly in unison. While the height of first clamping member 44 is generally kept to a minimum to reduce the weight of assembly 16 while providing sufficient strength therefor, bushings 38 and 40 preferably extend above and below member 44 in order to provide additional stability to the alignment of carriage assembly 16 to minimize frictional engagement with adjusting screw 30 so as to minimize the wear on the threads of screw 30 and of section 88 of engaging member 82. If replacement of engaging member 82 should be required, it is easily removed via passage 80 once carriage assembly 16 is removed from adjusting screw 30, as adjusting screw 30 is the only structure which retains engaging member 82 within passage 80 when assembly 16 is removed from router 18. Similarly, engaging member 64 may be easily removed and replaced via screw 66 if necessary. Engaging member 64 is formed of a hardened material for supporting the weight of carriage 16 and router 18 on ledge 78 when lifted by handle 12.

Thus, adjustment assembly 10 provides a mechanism for rapid vertical adjustment of a rotary cutter which is also conveniently combined with a fine adjustment mechanism for accurately and incrementally positioning the carriage assembly and rotary cutter at a desired height. The rapid adjustment mechanism is very simple and effective and conveniently ties directly into the fine adjustment mechanism, thereby producing a very streamlined mechanism involving a minimal number of moving parts.

It will be evident to one skilled in the art that a variety of changes can be made that are within the scope of the present invention. For instance, the rapid movement assembly may be configured as an independent unit for use without a fine adjustment mechanism or configured for use with a different fine adjustment mechanism. In addition, a lift handle may be configured for engagement with a carriage assembly to provide the convenience of lifting the assembly via the handle which extends above the table plate without the lift handle also serving to disengage the carriage assembly from the adjustment screw or another type of support assembly.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method of changing the distance between a rotary cutter disposed on a carriage assembly and a work surface, said method comprising the steps of:

providing a first mechanism on the carriage assembly for making small distance changes between the rotary cutter and the work surface;

providing a second mechanism on the carriage assembly for making larger distance changes between the rotary cutter and the work surface;

selecting one of the first and the second mechanisms to adjust the distance between the rotary cutter and the work surface; and activating the selected one of the first and the second mechanisms;

disengaging the first mechanism from the carriage assembly when the second mechanism is activated, and wherein the step of disengaging the first mechanism occurs automatically upon activation of the second mechanism.

2. The method as defined in claim 1, further comprising the step of:

changing the vertical distance between the rotary cutter and the work surface by a first distance if the first mechanism is selected; or changing the vertical distance between the rotary cutter and the work surface by a second distance if the second mechanism is selected, where the second distance is greater than the first distance.

3. A method of changing the distance between a rotary cutter disposed on a carriage assembly and a work surface, said method comprising the steps of:

providing a first mechanism on the carriage assembly for making small distance changes between the rotary cutter and the work surface;

providing a second mechanism on the carriage assembly for making larger distance changes between the rotary cutter and the work surface;

selecting one of the first and the second mechanisms to adjust the distance between the rotary cutter and the work surface; and activating the selected one of the first and the second mechanisms;

disengaging the first mechanism from the carriage assembly when the second mechanism is activated; and transferring support of the weight of the carriage assembly from the first mechanism to the second mechanism prior to disengaging the first mechanism from the carriage assembly.

4. The method as defined in claim 3, wherein the step of disengaging the first mechanism by activating the second mechanism further includes the step of:

moving an adjustment screw engaging member through a horizontal passageway in the carriage assembly from a first position to a second position, where the passageway extends between a vertically extending first opening and a vertically extending second opening, and when the adjustment screw engaging member is in the first position, a region thereof is engaged with an adjustment screw of the first mechanism which extends through the second opening; and when in the second position, the region of the adjustment screw engaging member is disengaged from the adjustment screw.

5. The method as defined in claim 4, wherein the step of moving the adjustment screw engaging member through the horizontal passageway further includes the step of:

sliding the adjustment screw engaging member horizontally through the horizontal passageway between the first and second positions.

6. The method as defined in claim 5, wherein the step of sliding the adjustment screw engagement member into the first position further includes the step of:

spring biasing a threaded section of the region of the adjustment screw engagement member into engagement with a threaded portion of the adjustment screw by way of spring members disposed in the passageway.

7. The method as defined in claim 6, wherein the step of sliding the adjustment screw engagement member into the second position further includes the step of:

moving the adjustment screw engagement member against the spring bias of the spring members.

8. The method as defined in claim 5, wherein the step of sliding the adjustment screw engaging member horizontally through the passageway and into the first position further includes the step of rotating a lift handle of the second mechanism in a first direction about a vertical axis, and the step of moving the adjustment screw engaging member through the passageway and into the second position includes the step of rotating the lift handle in a second direction about the vertical axis.

9. The method as defined in claim 8, wherein the step of transferring the weight of the carriage assembly to the second mechanism further includes the step of:

rotating the lift handle about the vertical axis to engage a projection on the carriage assembly in an arcuate circumferentially extending groove on a vertically extending rod of the lift handle.

10. The method as defined in claim 9, further comprising the step of vertically raising or lowering the lift handle of the second mechanism in order to change the vertical distance between the rotary cutter and the work surface.

11. The method as defined in claim 10, wherein the step of vertically raising or lowering the lift handle occurs after the projection on the carriage assembly is engaged in the groove on the rod and the adjustment screw engagement mechanism has been moved to the second position.

12. The method as defined in claim 1, wherein the step of disengaging the first mechanism by activating the second mechanism further includes the step of:

moving an adjustment screw engaging member through a horizontal passageway in the carriage assembly from a first position to a second position, where the passageway extends between a vertically extending first opening and a vertically extending second opening, and when the adjustment screw engaging member is in the first position, a region thereof is engaged with an adjustment screw of the first mechanism which extends through the second opening; and when in the second position, the region of the adjustment screw engaging member is disengaged from the adjustment screw.

13. The method as defined in claim 12, wherein the step of moving the adjustment screw engaging member through the horizontal passageway further includes the step of:

sliding the adjustment screw engaging member horizontally through the horizontal passageway between the first and second positions.

14. The method as defined in claim 13, wherein the step of sliding the adjustment screw engagement member into the first position further includes the step of:

spring biasing a threaded section of the region of the adjustment screw engagement member into engagement with a threaded portion of the adjustment screw by way of spring members disposed in the passageway.

15. The method as defined in claim 14, wherein the step of sliding the adjustment screw engagement member into the second position further includes the step of:

moving the adjustment screw engagement member against the spring bias of the spring members.

16. The method as defined in claim 13, wherein the step of sliding the adjustment screw engaging member horizontally through the passageway and into the first position further includes the step of rotating a lift handle of the second mechanism in a first direction about a vertical axis, and the step of moving the adjustment screw engaging member through the passageway and into the second position includes the step of rotating the lift handle in a second direction about the vertical axis.

17. The method as defined in claim 3, further comprising the step of:

changing the vertical distance between the rotary cutter and the work surface by a first distance if the first mechanism is selected; or changing the vertical distance between the rotary cutter and the work surface by a second distance if the second mechanism is selected, where the second distance is greater than the first distance.

18. The method as defined in claim 3, wherein the step of disengaging the first mechanism occurs automatically upon activation of the second mechanism.

* * * * *